US009670655B2

(12) United States Patent
Fry et al.

(10) Patent No.: US 9,670,655 B2
(45) Date of Patent: Jun. 6, 2017

(54) VALVE ASSEMBLY FOR FAUCET

(71) Applicant: Moen Incorporated, North Olmsted, OH (US)

(72) Inventors: Michael L. Fry, Bay Village, OH (US); Dale A. Pulver, Oberlin, OH (US)

(73) Assignee: Moen Incorporated, North Olmsted, OH (US)

( * ) Notice: Subject to any disclaimer, the term of this patent is extended or adjusted under 35 U.S.C. 154(b) by 14 days.

(21) Appl. No.: 14/710,978

(22) Filed: May 13, 2015

(65) Prior Publication Data

US 2016/0333554 A1 Nov. 17, 2016

(51) Int. Cl.
*E03C 1/186* (2006.01)
*E03C 1/04* (2006.01)

(52) U.S. Cl.
CPC ..... *E03C 1/0403* (2013.01)

(58) Field of Classification Search
CPC ... Y10T 137/9464; E03C 1/04; E03C 1/0401; E03C 1/0403
USPC ..... 137/603, 606, 625.4, 625.41, 801; 4/695
See application file for complete search history.

(56) References Cited

U.S. PATENT DOCUMENTS 5,746,244 A * 5/1998 Woolley, Sr. ..... E03C 1/04 137/359
7,269,864 B2 * 9/2007 Brown ..... E03C 1/0401 4/678
7,404,413 B2 * 7/2008 Chang ..... E03C 1/04 137/359
9,303,391 B2 * 4/2016 Leichty ..... E03C 1/0401
2008/0196776 A1 * 8/2008 Ko ..... E03C 1/04 137/603
2011/0209793 A1 * 9/2011 Ko ..... E03C 1/0401 138/140
2012/0067978 A1 * 3/2012 Leichty ..... E03C 1/0403 239/417.5
2012/0097279 A1 * 4/2012 Ko ..... E03C 1/04 137/801
2013/0213509 A1 * 8/2013 Thomas ..... E03C 1/04 137/801
2013/0248005 A1 9/2013 Pitsch et al.

OTHER PUBLICATIONS

Delta Foundations Faucet Product, the Delta Foundations Faucet Product shown in the cited document was publicly available prior to May 13, 2015, 3 pages.
Delta Lorain Faucet Product, the Delta Lorain Faucet Product shown in the cited document was publicly available prior to May 13, 2015, 3 pages.
Delta Addison Faucet Product, the Delta Addison Faucet Product shown in the cited document was publicly available prior to May 13, 2015, 2 pages.
Delta Dryden and Lahara Faucet Products, the Delta Dryden and Lahara Faucet Products shown in the cited document were publicly available prior to May 13, 2015, 3 pages.

* cited by examiner

*Primary Examiner* — Reinaldo Sanchez-Medina
(74) *Attorney, Agent, or Firm* — Calfee, Halter & Griswold LLP

(57) ABSTRACT

The present invention provides a valve assembly for a faucet that provides a rigid mounting for valve bodies.

20 Claims, 21 Drawing Sheets

VALVE ASSEMBLY FOR FAUCET

FIELD

The present invention relates generally to a valve assembly for a faucet, and, more particularly, to a valve assembly for a faucet that provides a rigid mounting for valve bodies.

BACKGROUND

A valve assembly for a faucet includes valve bodies that need to be rigidly mounted. Prior valve assemblies require complicated and/or expensive structure to rigidly mount the valve bodies or do not rigidly mount the valve bodies.

SUMMARY

The present invention provides a valve assembly for a faucet that provides a rigid mounting for valve bodies.

In an exemplary embodiment, the valve assembly includes a first valve body, a second valve body, and a tray. The first valve body includes a first end section and a second end section. The first end section includes a first opening. The first opening is operable to fluidly connect to a water supply. The second end section includes a second opening. The second opening is operable to receive a valve cartridge. The first valve body includes a passageway extending between the first opening and the second opening. The first valve body includes a third opening between the first end section and the second end section. The third opening is in fluid communication with the passageway. The first valve body includes a key extending outwardly therefrom between the first end section and the second end section. The second valve body includes a first end section and a second end section. The first end section includes a first opening. The first opening is operable to fluidly connect to a water supply. The second end section includes a second opening. The second opening is operable to receive a valve cartridge. The second valve body includes a passageway extending between the first opening and the second opening. The second valve body includes a third opening between the first end section and the second end section. The third opening is in fluid communication with the passageway. The second valve body includes a key extending outwardly therefrom between the first end section and the second end section. The tray includes a first end section, a second end section, and an intermediate section. The first end section includes a first opening. The tray includes a first keyway extending outwardly from the first opening. The first opening is operable to receive the first valve body with the first keyway in the tray being operable to receive the key on the first valve body. The second end section including a second opening. The tray including a second keyway extending outwardly from the second opening. The second opening being operable to receive the second valve body with the second keyway in the tray being operable to receive the key on the second valve body. The intermediate section extending between the first opening and the second opening. The tray including a ridge. The ridge extending around a portion of the intermediate section of the tray.

In an exemplary embodiment, the valve assembly includes a first valve body, a second valve body, and a tray. The first valve body includes a first end section and a second end section. The first end section includes a first opening. The first opening is operable to fluidly connect to a water supply. The second end section includes a second opening. The second opening is operable to receive a valve cartridge.

The first valve body includes a passageway extending between the first opening and the second opening. The first valve body includes a third opening between the first end section and the second end section. The third opening is in fluid communication with the passageway. The first valve body includes a key extending outwardly therefrom between the first end section and the second end section. The second valve body includes a first end section and a second end section. The first end section includes a first opening. The first opening is operable to fluidly connect to a water supply. The second end section includes a second opening. The second opening is operable to receive a valve cartridge. The second valve body includes a passageway extending between the first opening and the second opening. The second valve body includes a third opening between the first end section and the second end section. The third opening is in fluid communication with the passageway. The second valve body includes a key extending outwardly therefrom between the first end section and the second end section. The tray includes a first end section, a second end section, and an intermediate section. The first end section includes a first opening. The tray includes a first keyway extending outwardly from the first opening. The first opening is operable to receive the first valve body with the first keyway in the tray being operable to receive the key on the first valve body. The second end section including a second opening. The tray including a second keyway extending outwardly from the second opening. The second opening being operable to receive the second valve body with the second keyway in the tray being operable to receive the key on the second valve body. The intermediate section extending between the first opening and the second opening. The tray including a ridge. The ridge extending around at least sixty-five percent of the intermediate section of the tray.

In an exemplary embodiment, the valve assembly includes a first valve body, a second valve body, and a tray. The first valve body includes a first end section and a second end section. The first end section includes a first opening. The first opening is operable to fluidly connect to a water supply. The second end section includes a second opening. The second opening is operable to receive a valve cartridge. The first valve body includes a passageway extending between the first opening and the second opening. The first valve body includes a third opening between the first end section and the second end section. The third opening is in fluid communication with the passageway. The first valve body includes a key extending outwardly therefrom between the first end section and the second end section. The second valve body includes a first end section and a second end section. The first end section includes a first opening. The first opening is operable to fluidly connect to a water supply. The second end section includes a second opening. The second opening is operable to receive a valve cartridge. The second valve body includes a passageway extending between the first opening and the second opening. The second valve body includes a third opening between the first end section and the second end section. The third opening is in fluid communication with the passageway. The second valve body includes a key extending outwardly therefrom between the first end section and the second end section. The tray includes a first end section, a second end section, and an intermediate section. The first end section includes a first opening. The tray includes a first keyway extending outwardly from the first opening. The first opening is operable to receive the first valve body with the first keyway in the tray being operable to receive the key on the first valve body. The second end section including a second opening. The tray including a second keyway extending outwardly from the second opening. The second opening being operable to receive the second valve body with the second keyway in the tray being operable to receive the key on the second valve body. The intermediate section extending between the first opening and the second opening. The tray including a ridge. The ridge extending around at least thirty-five percent of the tray.

BRIEF DESCRIPTION OF THE DRAWINGS

—FIG. 1*a* is a perspective view, FIG. 1*b* is an exploded perspective view, FIG. 1*c* is a front elevational view, FIG. 1*d* is a top plan view, FIG. 1*e* is a cross-sectional view taken along the line 1*e*-1*e* in FIG. 1*c*, FIG. 1*f* is a cross-sectional view taken along the line 1*f*-1*f* in FIG. 1*c*, FIG. 1*g* is a cross-sectional view taken along the line 1*g*-1*g* in FIG. 1*d*, and FIG. 1*h* is a cross-sectional view taken along the line 1*h*-1*h* in FIG. 1*d;*

—FIG. 2*a* is a perspective view and FIG. 2*b* is an exploded perspective view;

*—FIG. 3*a* is a perspective view, FIG. 3*b* is a front elevational view, FIG. 3*c* is a left side elevational view, FIG. 3*d* is a right side elevational view, FIG. 3*e* is a top plan view, FIG. 3*f* is a bottom plan view, and FIG. 3*g* is a cross-sectional view taken along the line 3*g*-3*g* in FIG. 3*c;*

*—FIG. 4*a* is a perspective view, FIG. 4*b* is an exploded perspective view, FIG. 4*c* is a top plan view, FIG. 4*d* is a bottom plan view, FIG. 4*e* is a cross-sectional view taken along the line 4*e*-4*e* in FIG. 4*c*, and FIG. 4*f* is a cross-sectional view taken along the line 4*f*-4*f* in FIG. 4*c;*

*—FIG. 5*a* is a perspective view, FIG. 5*b* is a front elevational view, FIG. 5*c* is a top plan view, and FIG. 5*d* is a cross-sectional view taken along the line 5*d*-5*d* in FIG. 5*c;*

*—FIG. 6*a* is a perspective view, FIG. 6*b* is a front elevational view, FIG. 6*c* is a right side elevational view, FIG. 6*d* is a top plan view, FIG. 6*e* is a bottom plan view, FIG. 6*f* is a cross-sectional view taken along the line 6*f*-6*f* in FIG. 6*b*, FIG. 6*g* is a cross-sectional view taken along the line 6*g*-6*g* in FIG. 6*b*, and FIG. 6*h* is a cross-sectional view taken along the line 6*h*-6*h* in FIG. 6*d;*

*—FIG. 7*a* is a perspective view, FIG. 7*b* is a front elevational view, FIG. 7*c* is a right side elevational view, FIG. 7*d* is a top plan view, FIG. 7*e* is a bottom plan view, FIG. 7*f* is a cross-sectional view taken along the line 7*f*-7*f* in FIG. 7*b*, and FIG. 7*g* is a cross-sectional view taken along the line 7*g*-7*g* in FIG. 7*d;*

*—FIG. 8*a* is a perspective view, FIG. 8*b* is a front elevational view, FIG. 8*c* is a left side elevational view, FIG. 8*d* is a top plan view, FIG. 8*e* is a bottom plan view, FIG. 8*f* is a cross-sectional view taken along the line 8*f*-8*f* in FIG. 8*b*, FIG. 8*g* is a cross-sectional view taken along the line 8*g*-8*g* in FIG. 8*d*, FIG. 8*h* is a cross-sectional view taken along the line 8*h*-8*h* in FIG. 8*d*, FIG. 8*i* is a cross-sectional view taken along the line 8*i*-8*i* in FIG. 8*d*, FIG. 8*j* is a cross-sectional view taken along the line 8*j*-8*j* in FIG. 8*d*, and FIG. 8*k* is a detail view of the circled area 8*k* in FIG. 8*j*; *—FIG. 9*a* is a perspective view, FIG. 9*b* is a front elevational view, FIG. 9*c* is a top plan view, FIG. 9*d* is a cross-sectional view taken along the line 9*d*-9*d* in FIG. 9*b*, FIG. 9*e* is a cross-sectional view taken along the line 9*e*-9*e* in FIG. 9*b*, and FIG. 9*f* is a cross-sectional view taken along the line 9*f*-9*f* in FIG. 9*c*.

DETAILED DESCRIPTION

The present invention provides a valve assembly for a faucet that provides a rigid mounting for valve bodies.

Figure 1A:
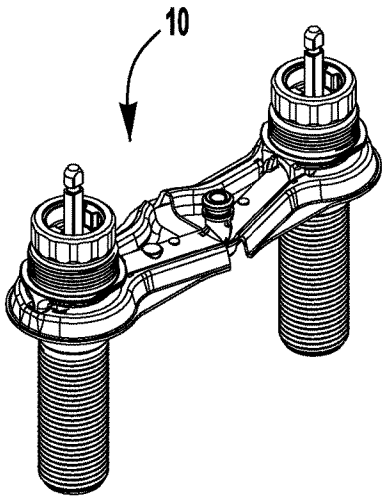
FIGS. 1*a*-1*h* are views of a valve assembly according to an exemplary embodiment of the present invention, including valve bodies, valve cartridges, cartridge nuts, a bridge, and a tray
Figure 1B:
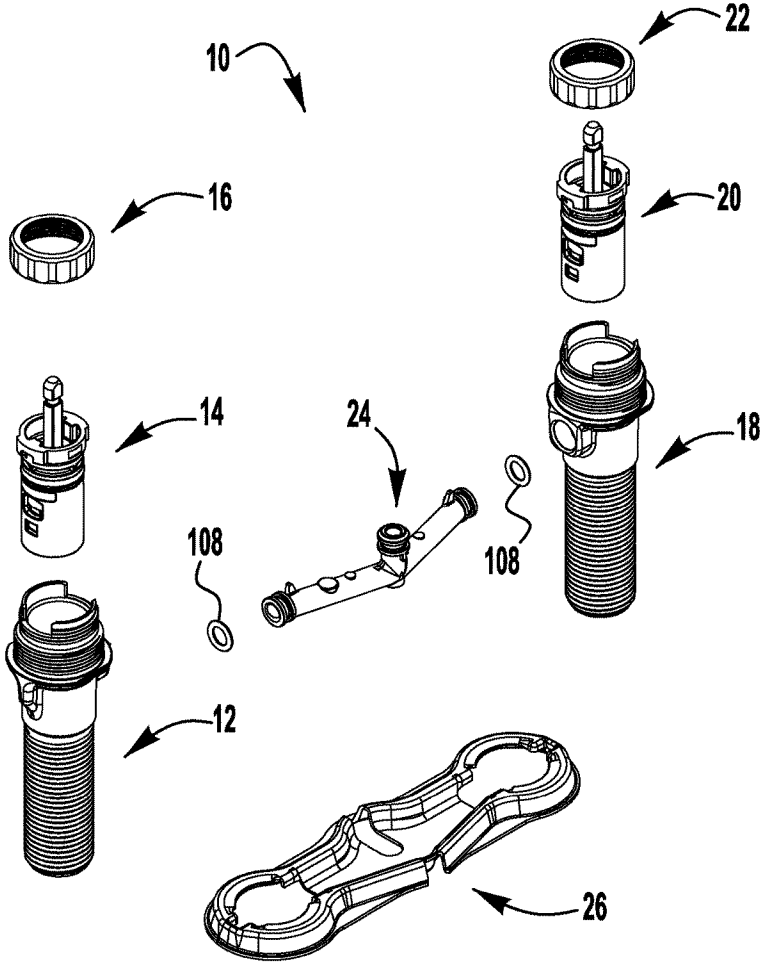
Figure 1D:
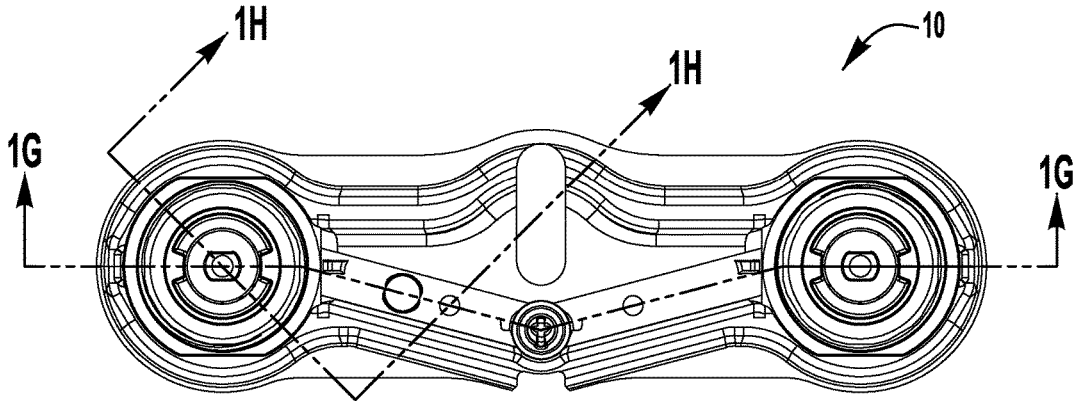
Figure 1C:
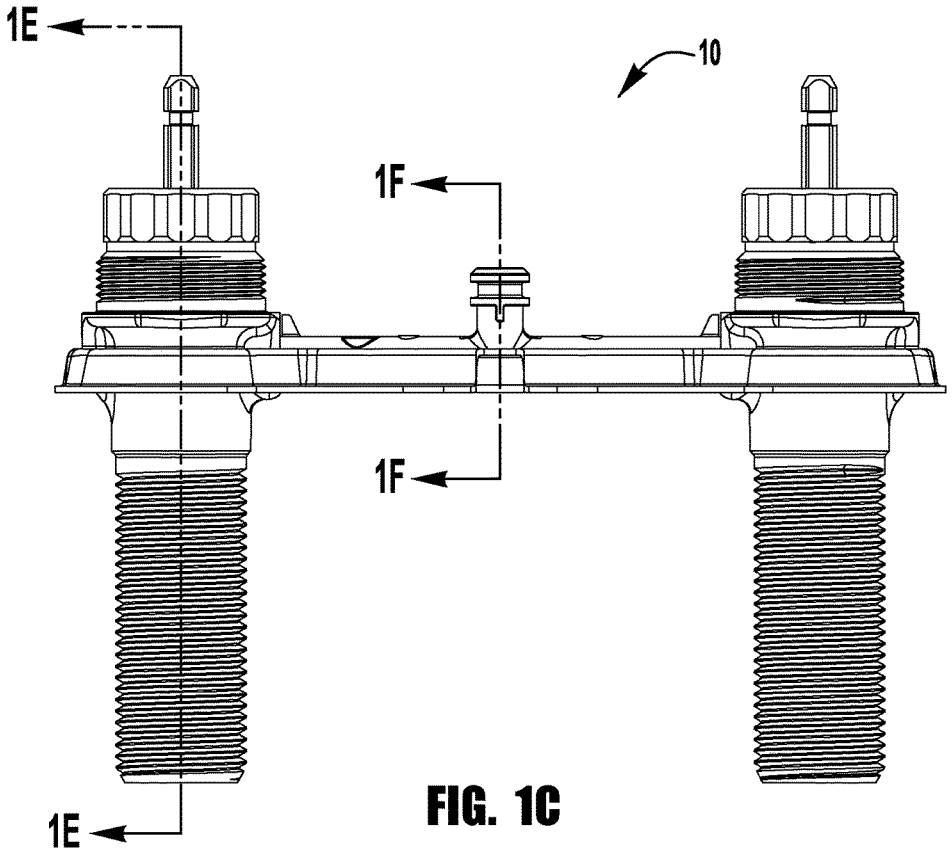
Figure 1E:
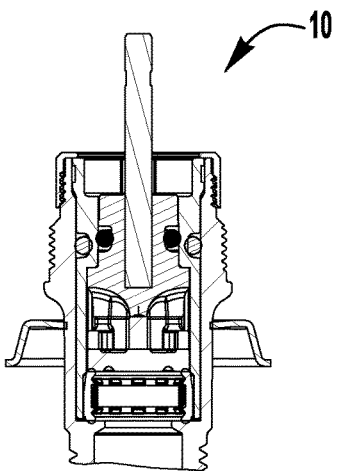
Figure 1F:
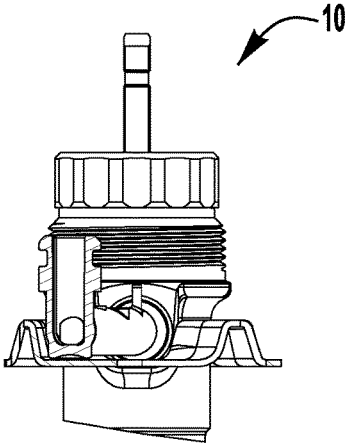
Figure 1H:
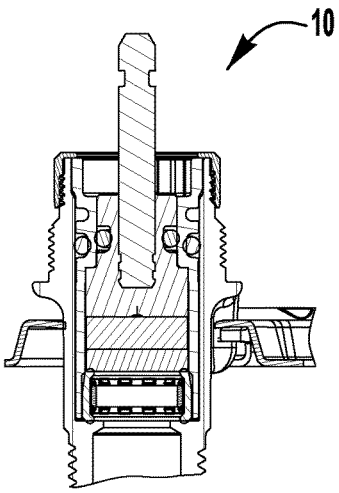
Figure 1G:
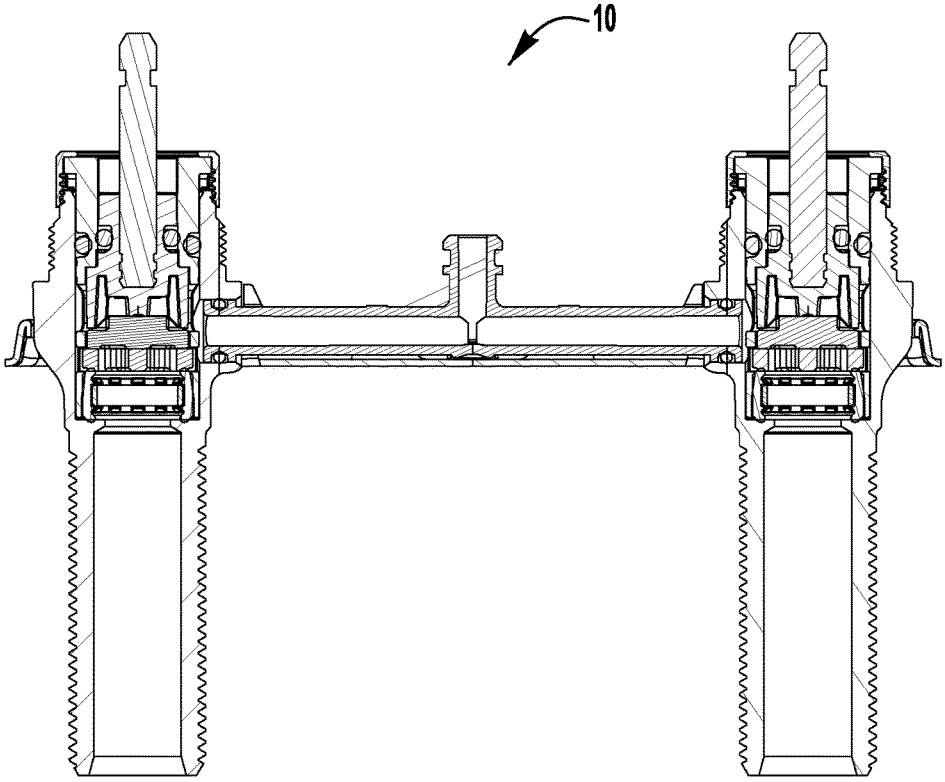
Figure 2A:
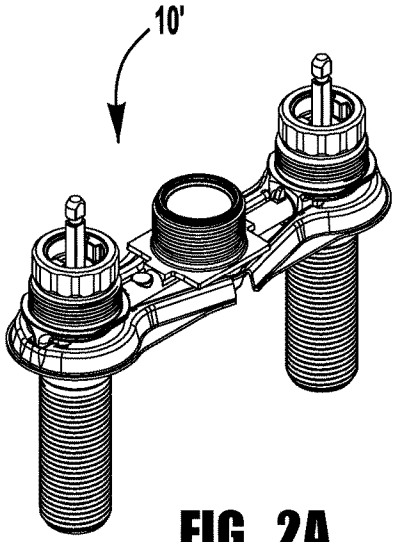
FIGS. 2*a*-2*b* are views of a valve assembly according to another exemplary embodiment of the present invention
Figure 2B:
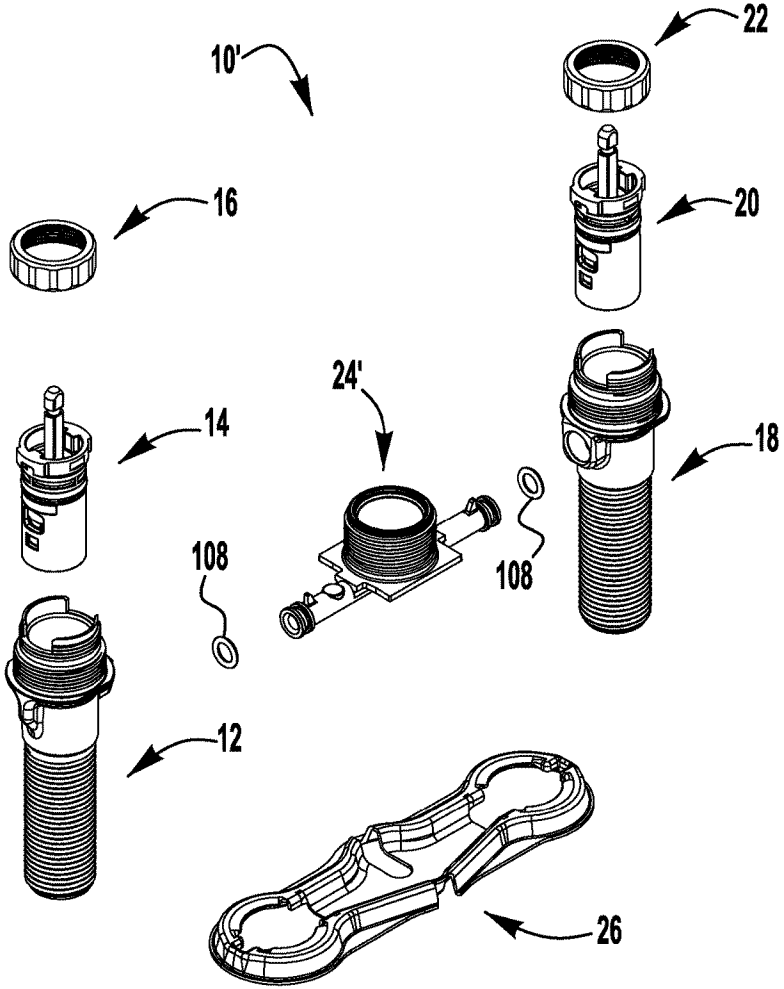
Figure 3A:
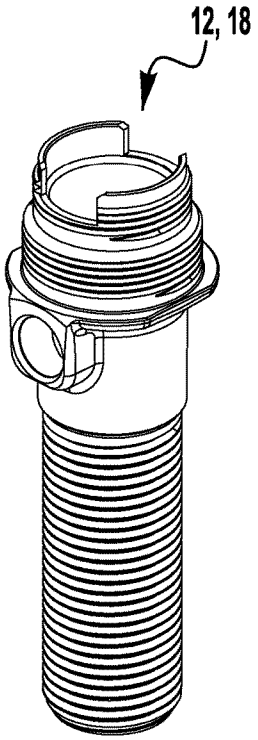
FIGS. 3*a*-3*g* are views of the valve bodies of FIGS. 1*a*-1*h* and 2*a*-2*b
Figure 3G:
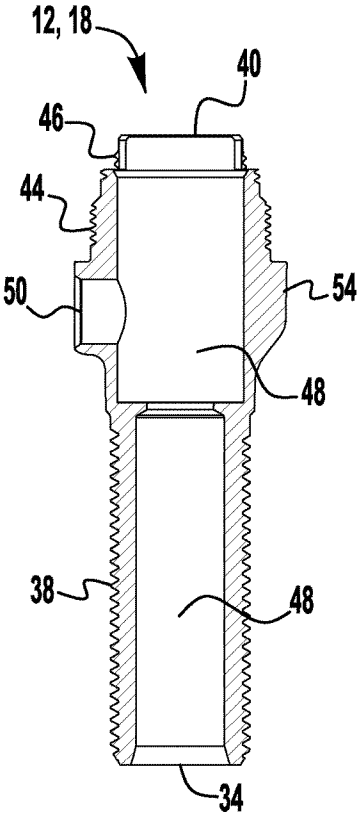
Figure 3E:
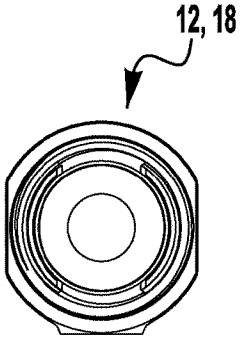
Figure 3F:
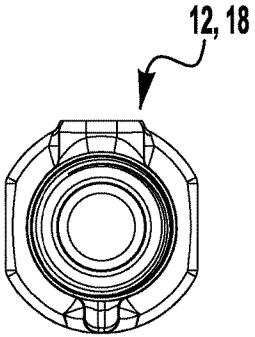
Figure 3D:
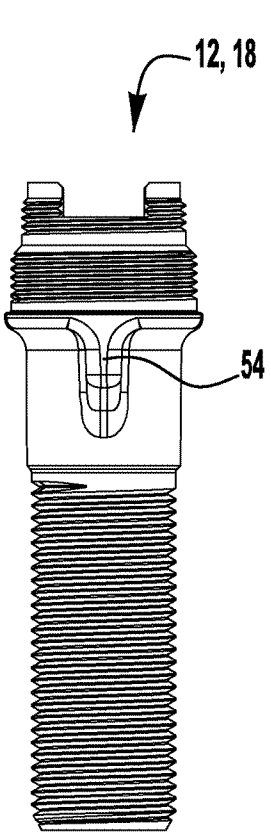
Figure 3B:
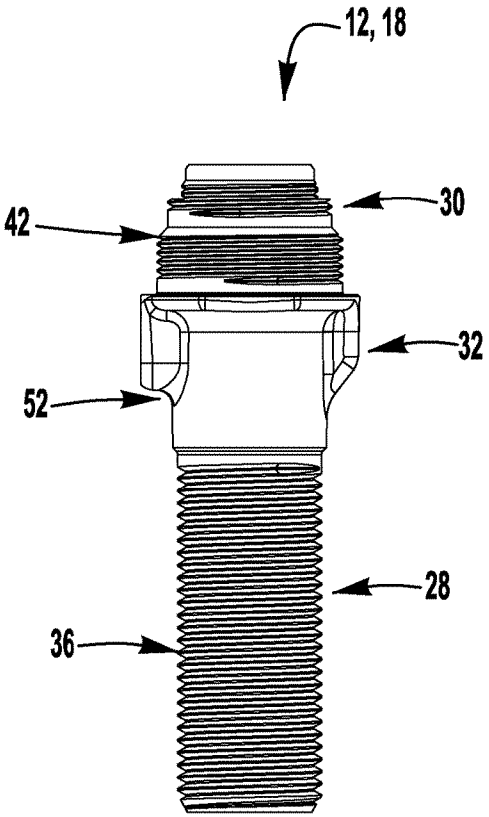
Figure 3C:
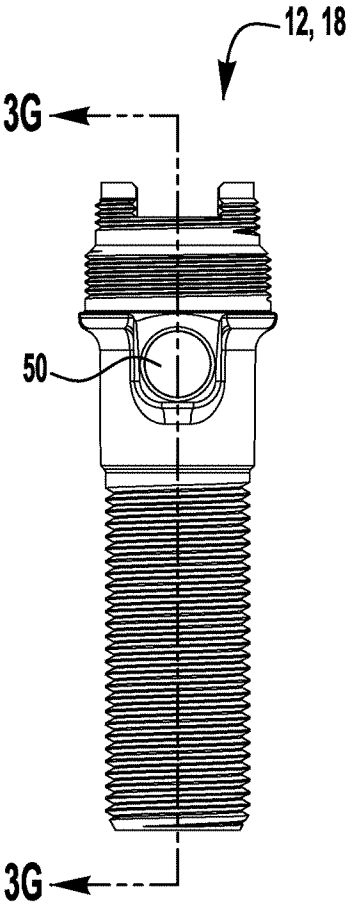
Figure 4B:
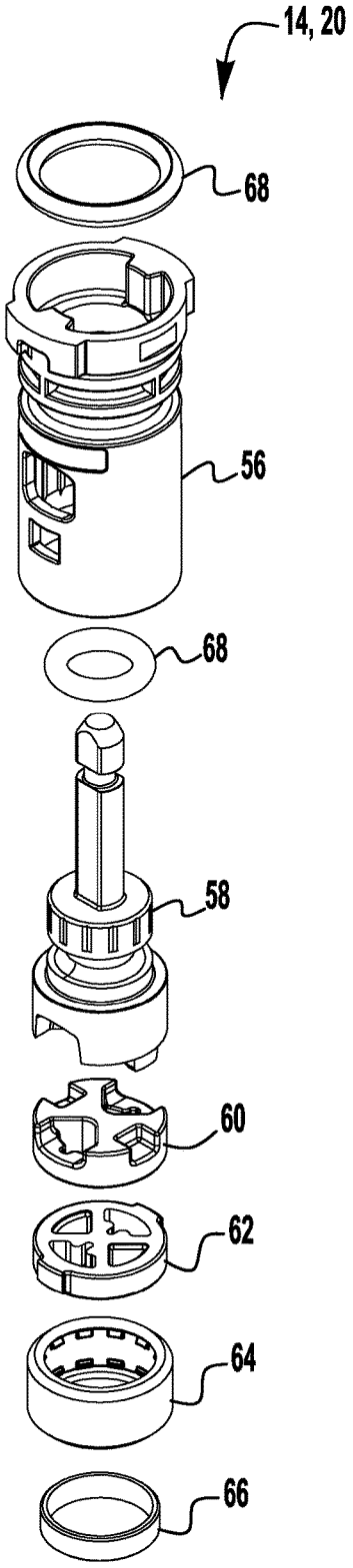
FIGS. 4*a*-4*f* are views of the valve cartridges of FIGS. 1*a*-1*h* and 2*a*-2*b
Figure 4A:
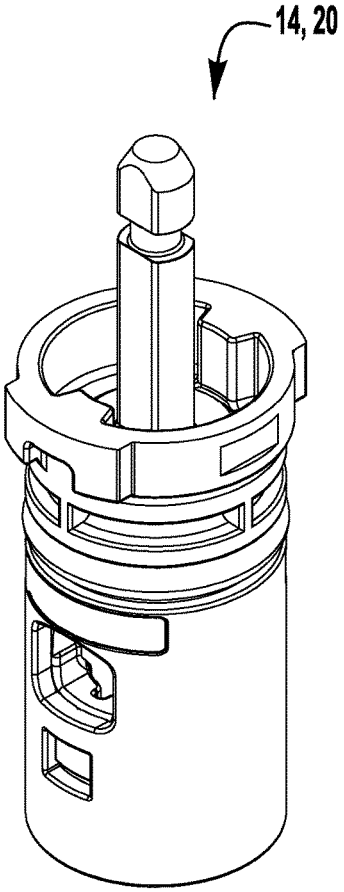
Figure 4C:
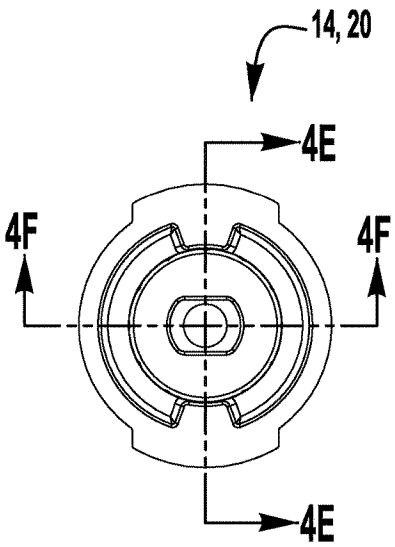
Figure 4E:
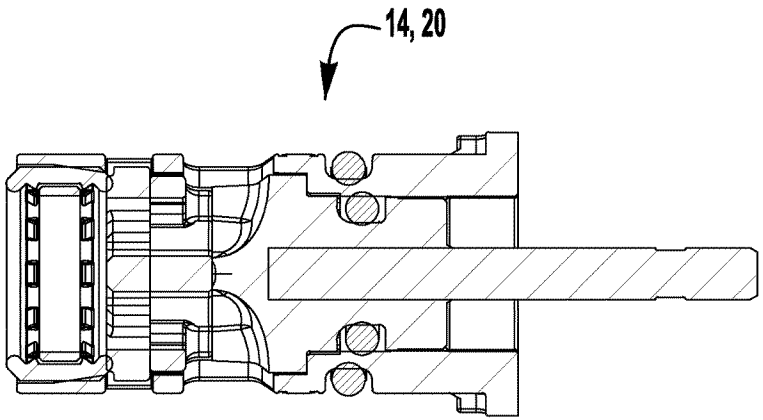
Figure 4F:
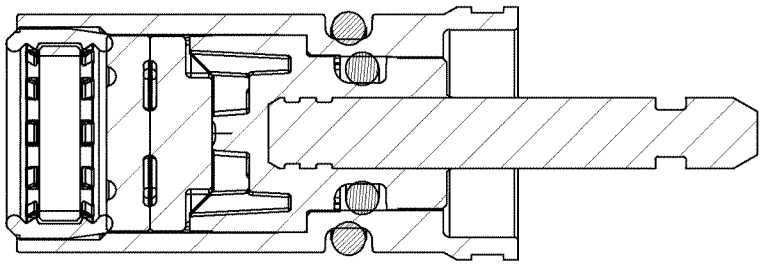
Figure 4D:
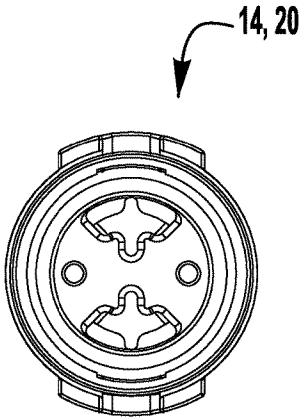
Figure 5A:
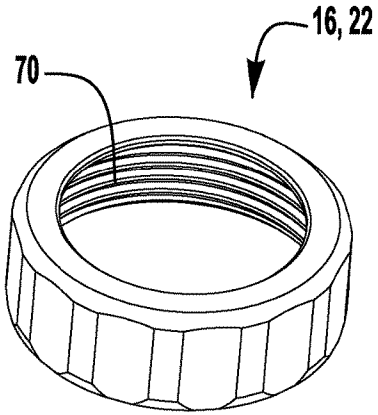
FIGS. 5*a*-5*d* are views of the cartridge nuts of FIGS. 1*a*-1*h* and 2*a*-2*b
Figure 5C:
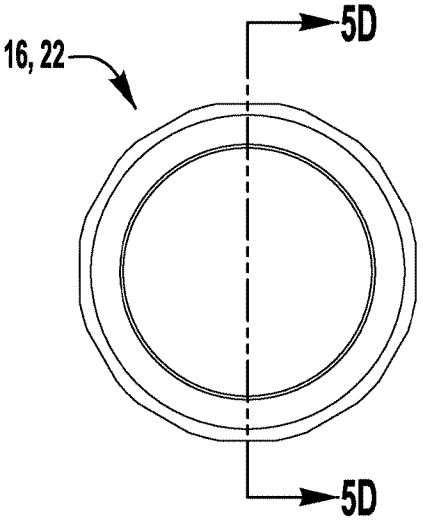
Figure 5B:
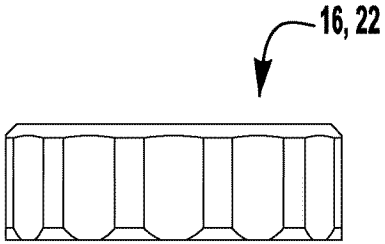
Figure 5D:
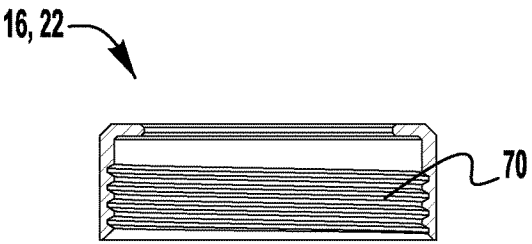
Figure 6A:
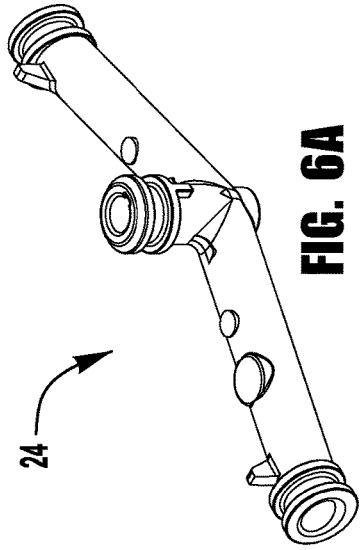
FIGS. 6*a*-6*h* are views of the bridge of FIGS. 1*a*-1*h
Figure 6C:
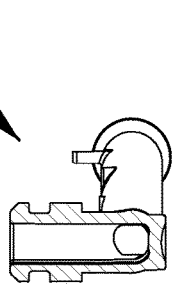
Figure 6D:
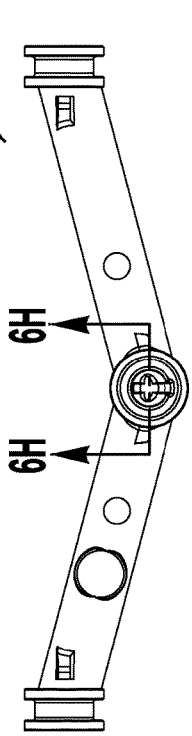
Figure 6B:
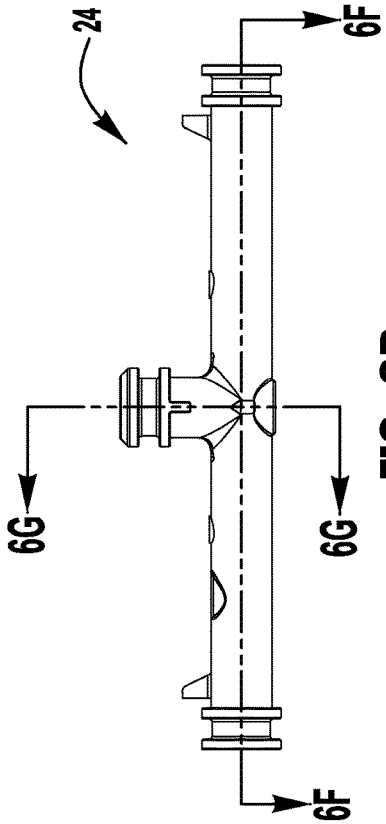
Figure 6E:
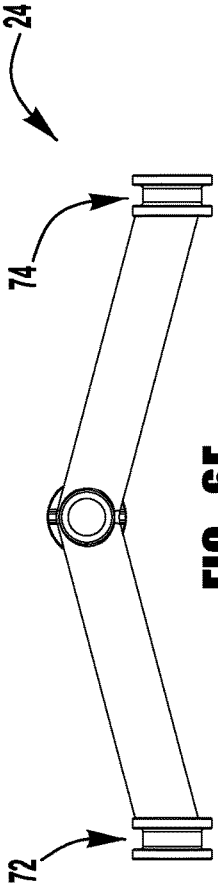
Figure 6F:
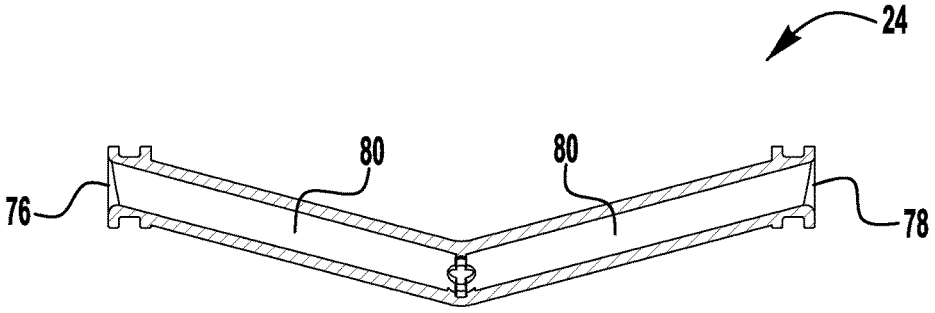
Figure 6G:
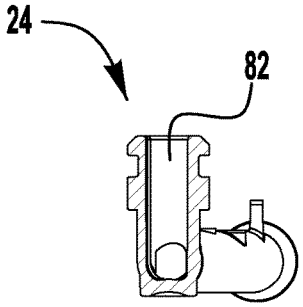
Figure 6H:
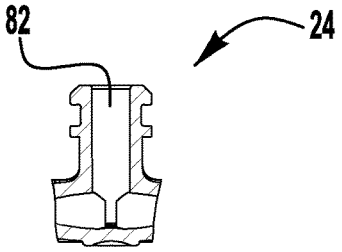
Figure 7A:
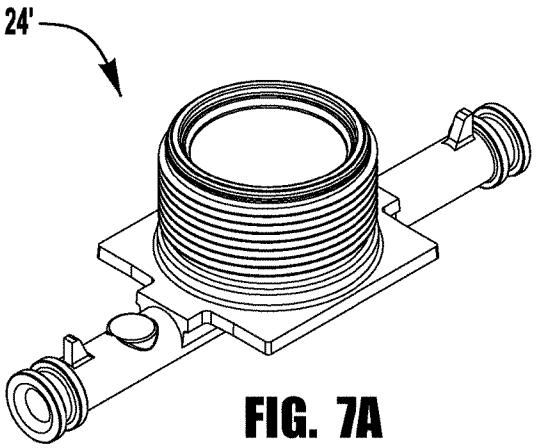
FIGS. 7*a*-7*g* are views of the bridge of FIGS. 2*a*-2*b
Figure 7C:
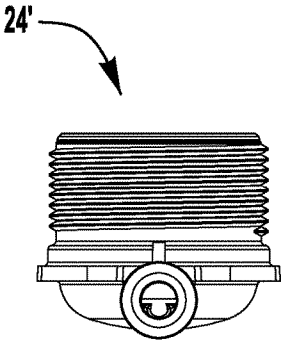
Figure 7D:
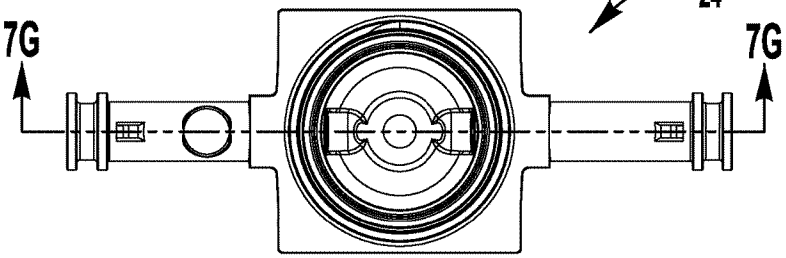
Figure 7B:
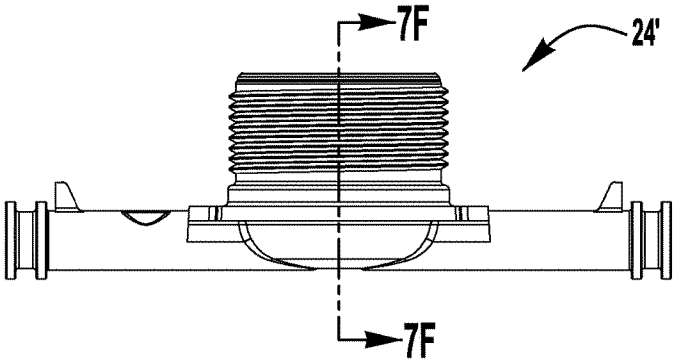
Figure 7E:
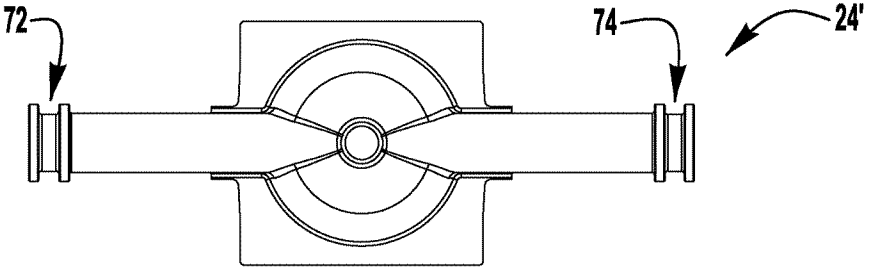
Figure 7F:
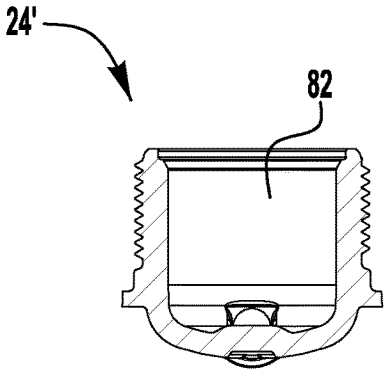
Figure 7G:
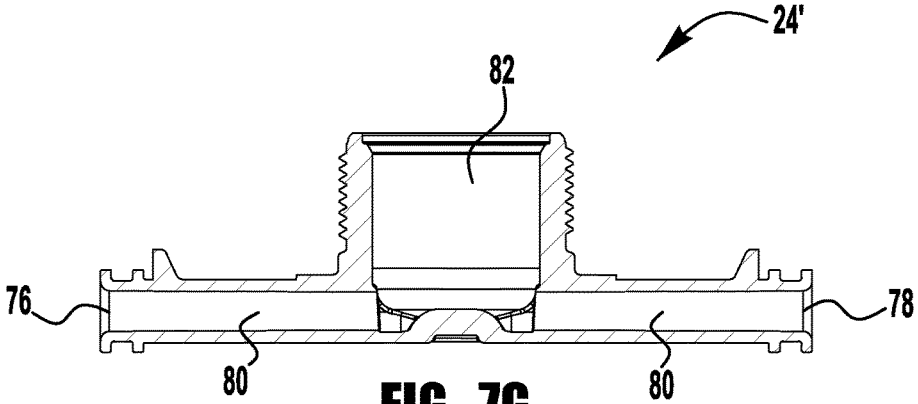
Figure 8A:
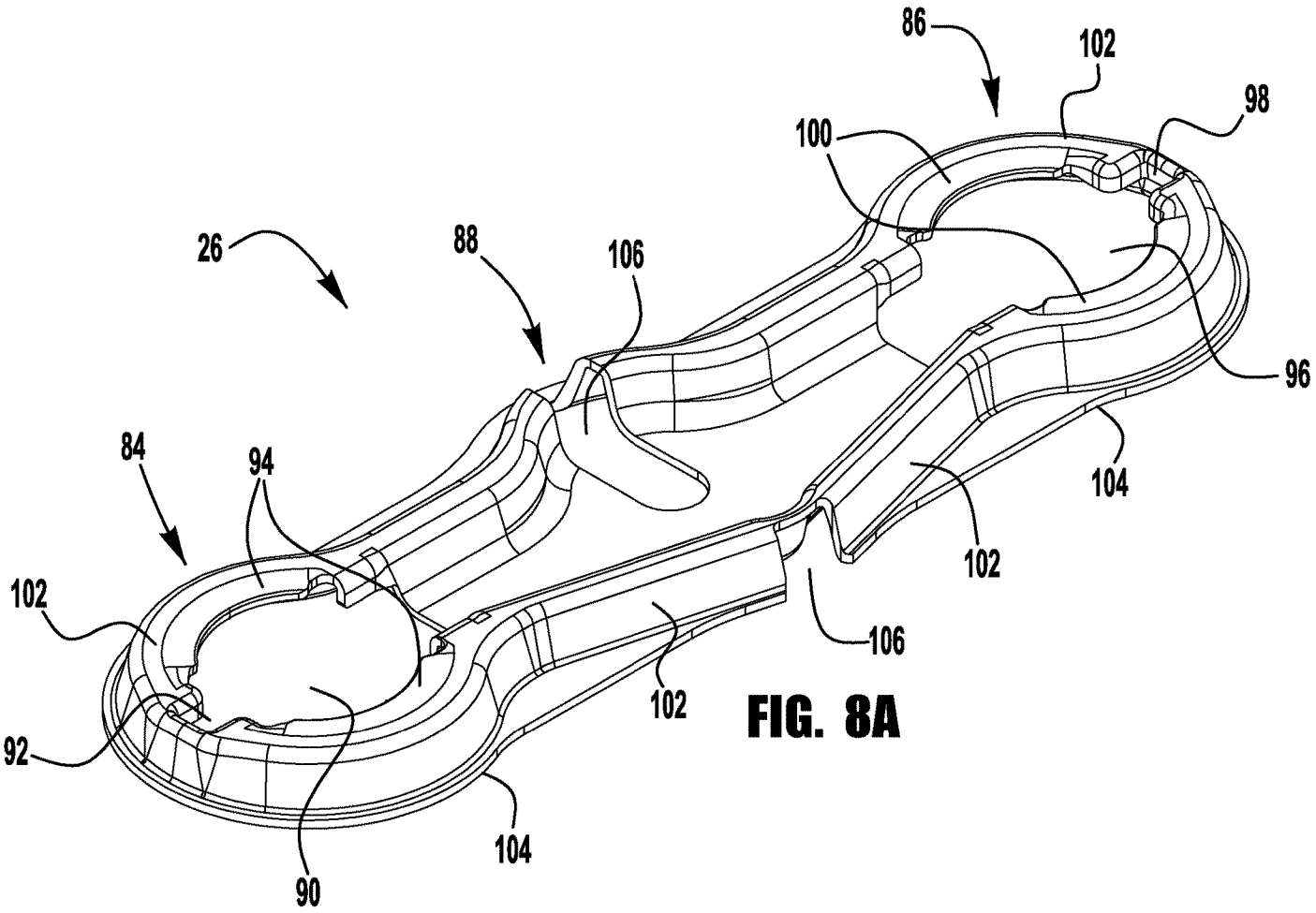
FIGS. 8*a*-8*k* are views of the tray of FIGS. 1*a*-1*h* and 2*a*-2*b
Figure 8D:
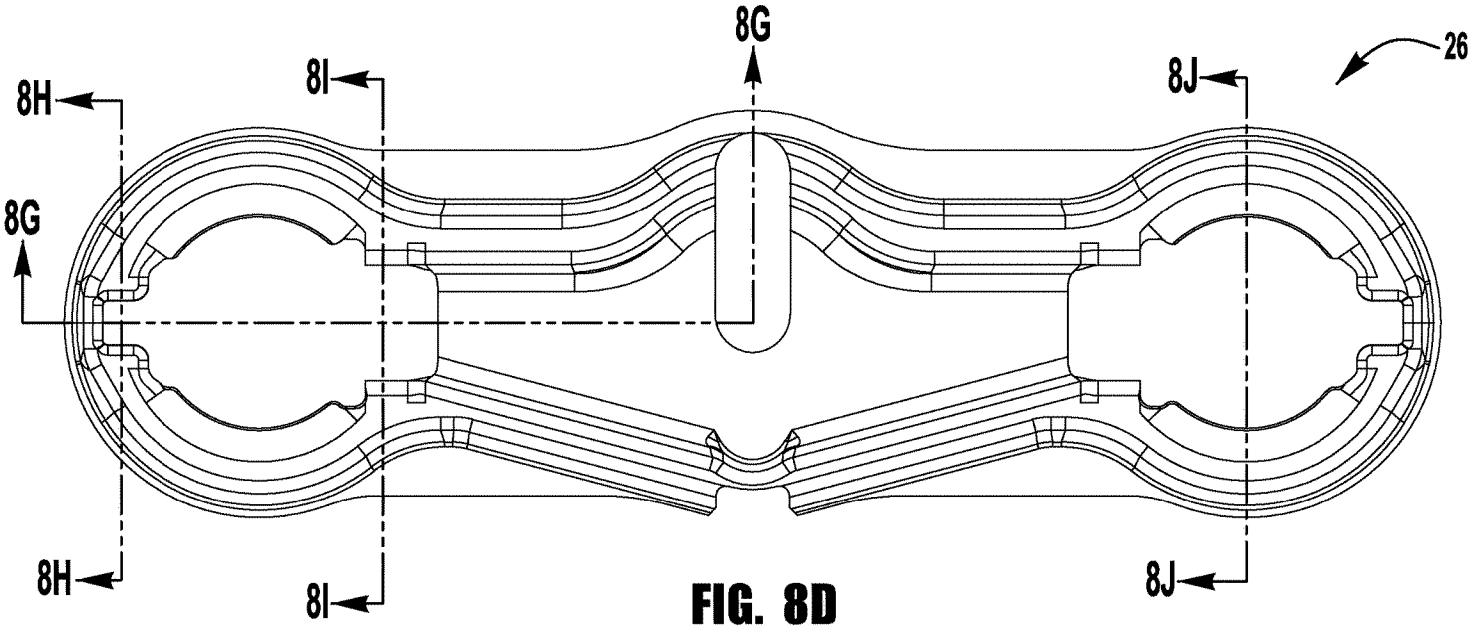
Figure 8B:
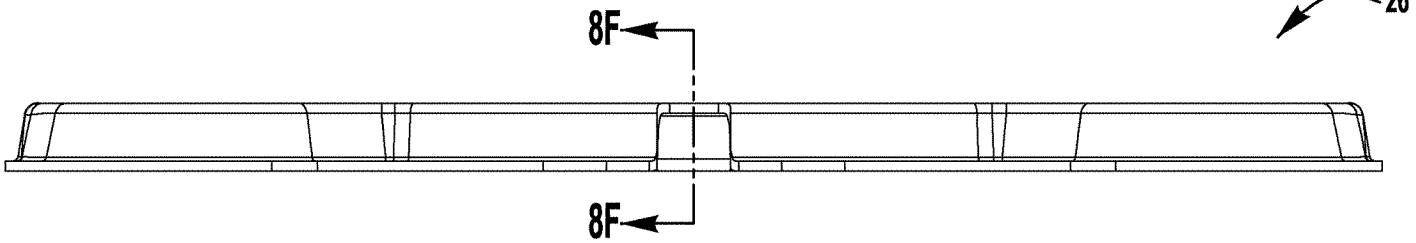
Figure 8E:
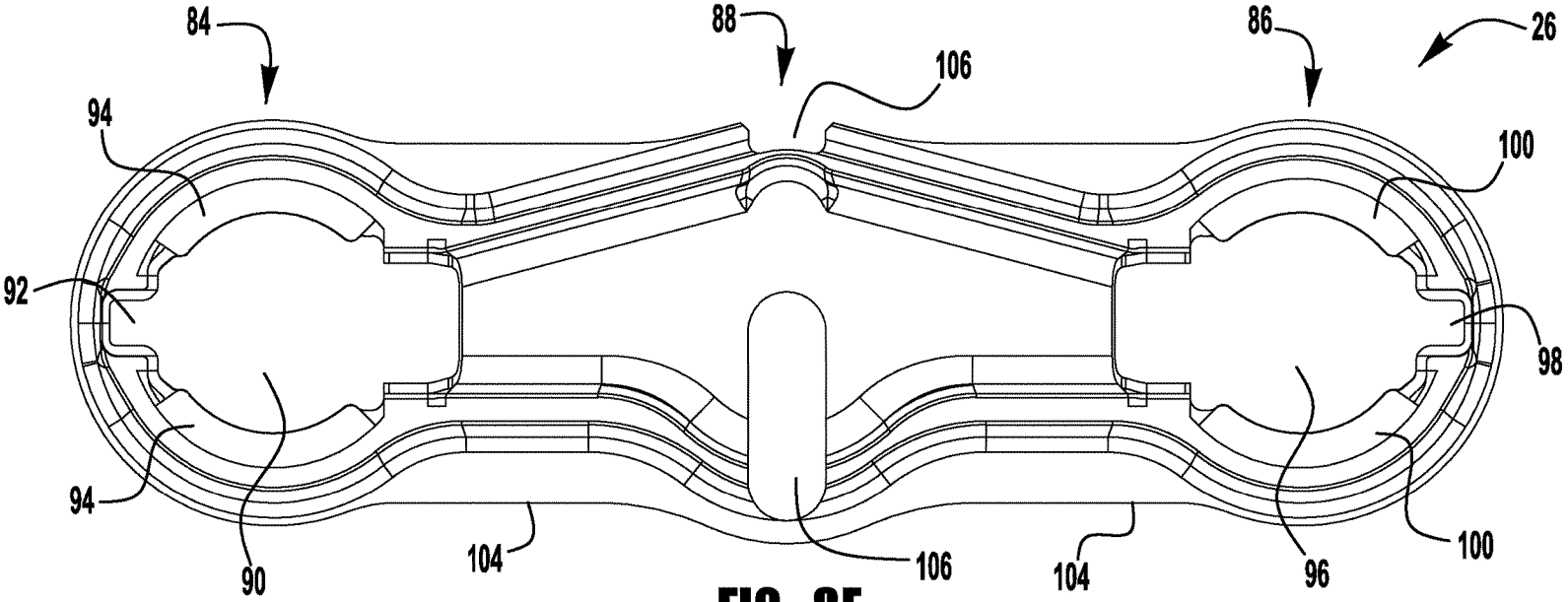
Figure 8C:
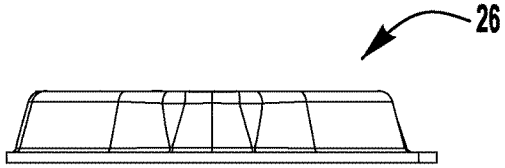
Figure 8F:
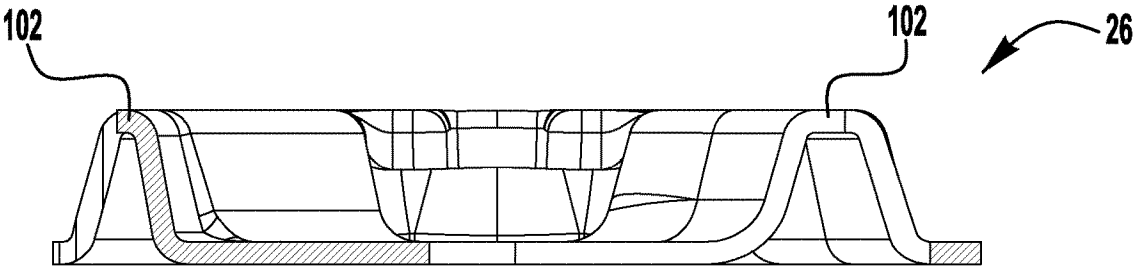
Figure 8G:
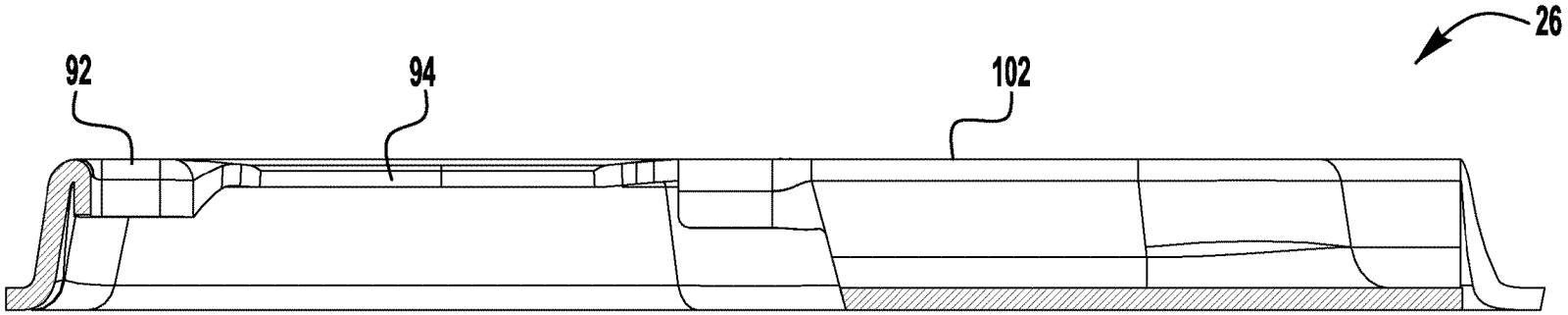
Figure 8K:
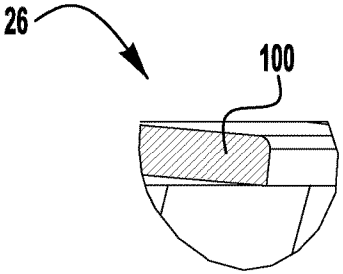
Figure 8H:
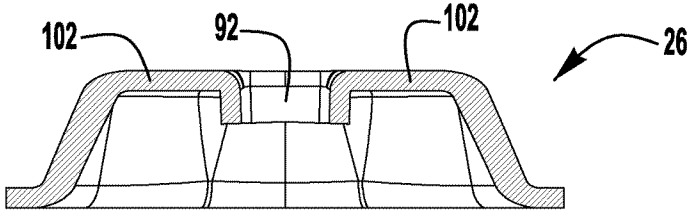
Figure 8I:
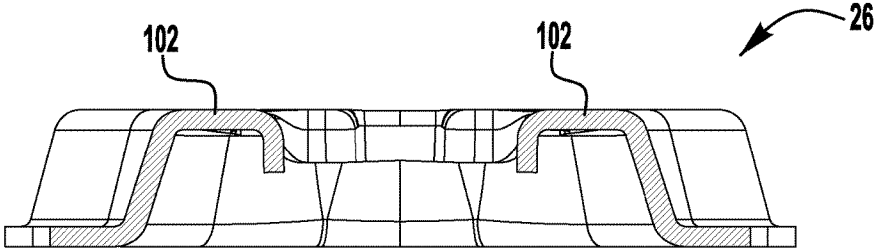
Figure 8J:
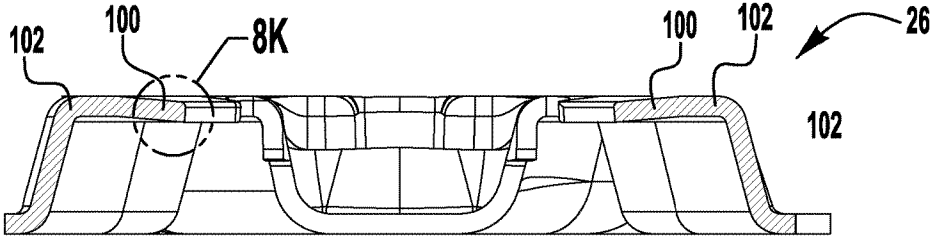
Figure 9A:
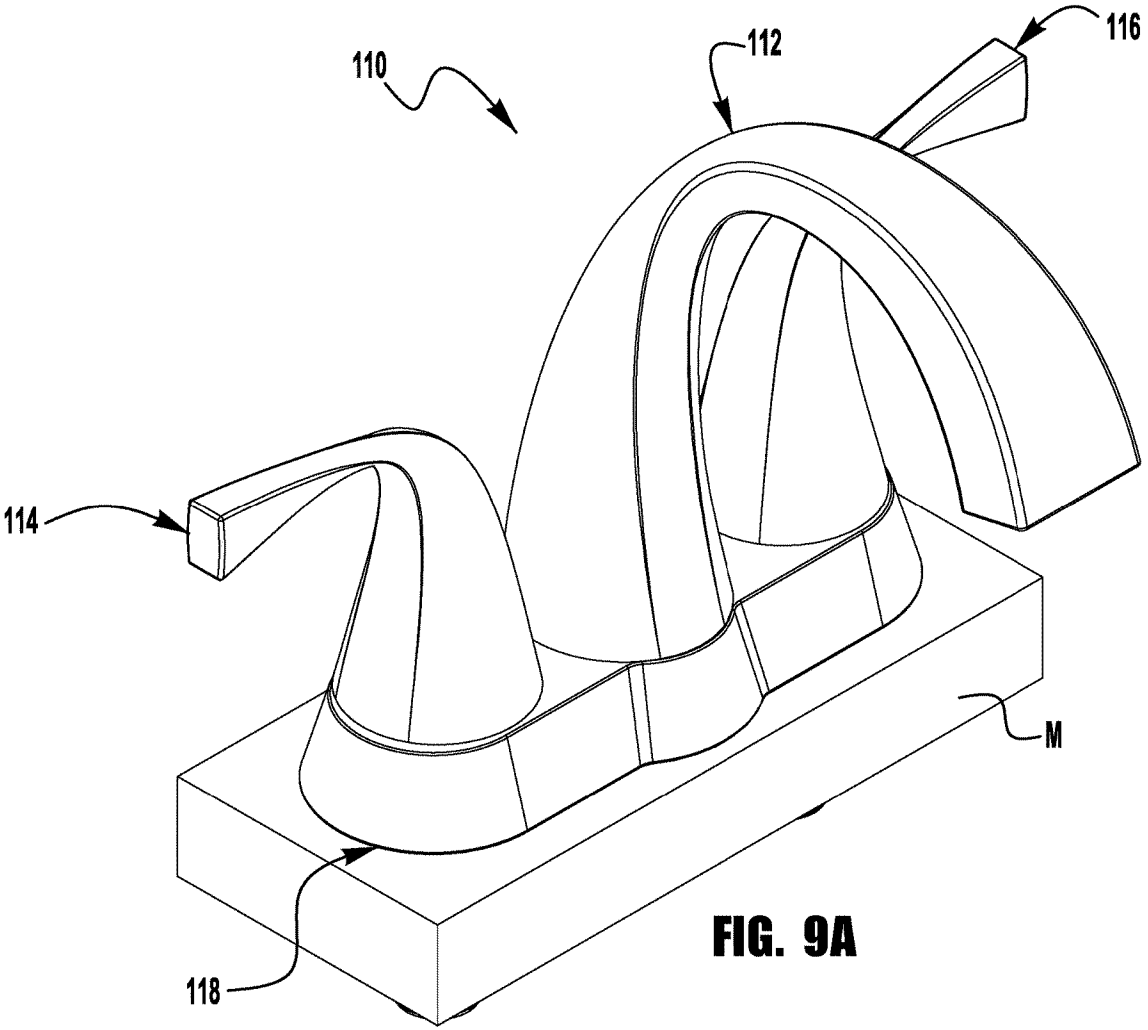
FIGS. 9*a*-9*f* are views of a faucet incorporating the valve assembly of FIGS. 1*a*-1*h
Figure 9E:
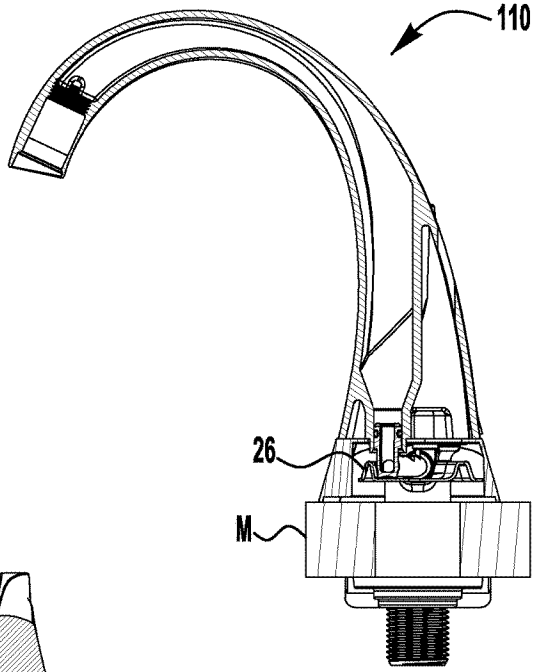
Figure 9D:
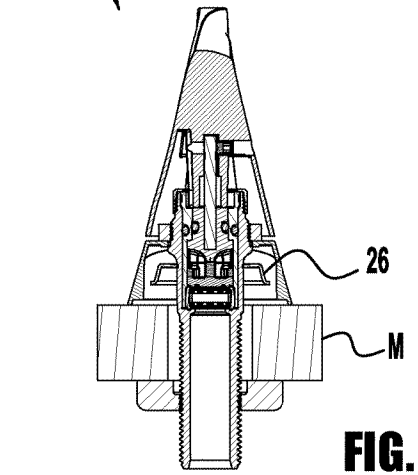
Figure 9B:
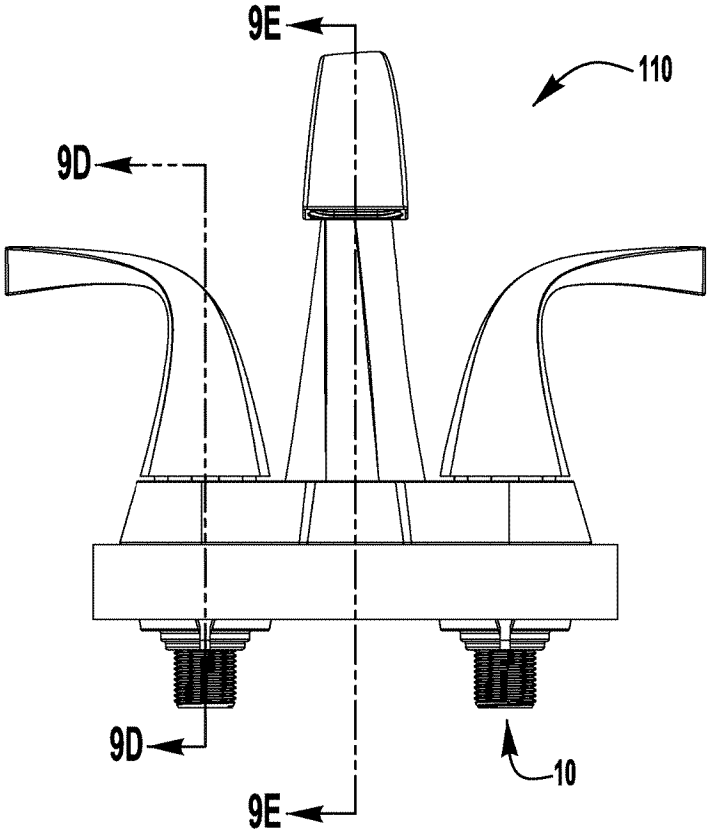
Figure 9C:
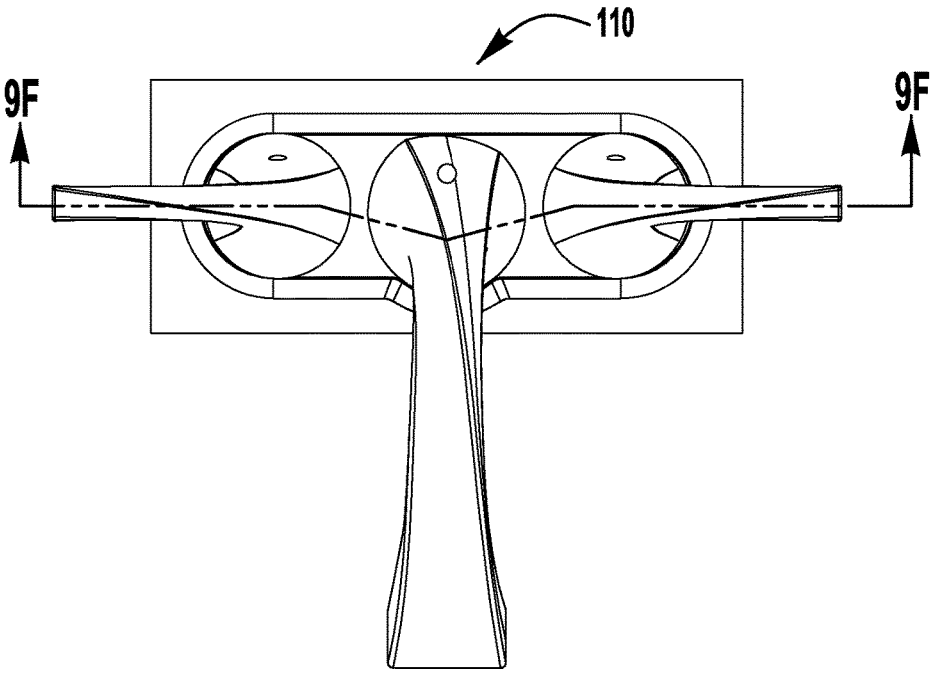
Figure 9F:
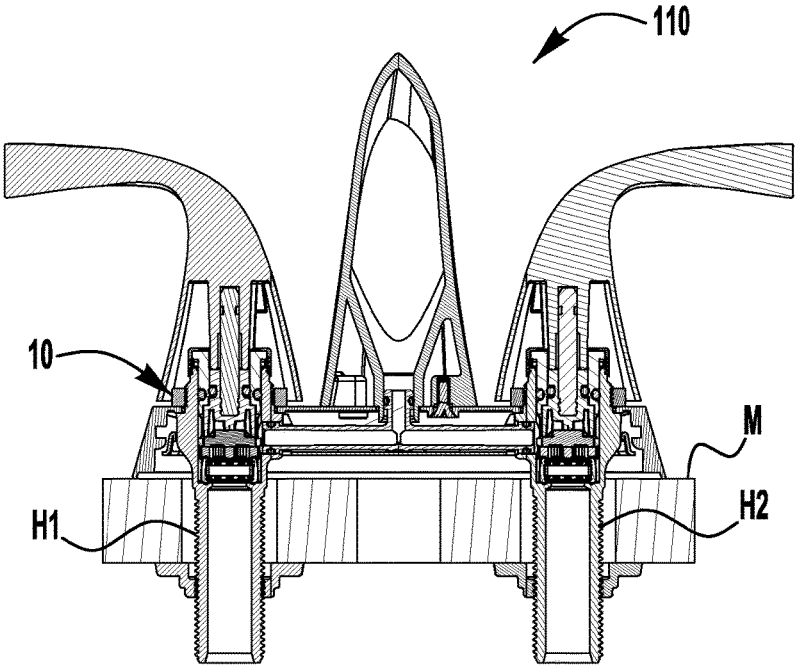

An exemplary embodiment of a valve assembly 10 of the present invention is shown in FIGS. 1*a*-1*h*. The valve assembly 10 is generally for use with a fixed spout. Another exemplary embodiment of a valve assembly 10' of the present invention is shown in FIGS. 2*a*-2*b*. The valve assembly 10' is generally for use with a swing spout.

In the illustrated embodiments, the valve assembly 10, 10' includes a first valve body 12, a first valve cartridge 14, a first cartridge nut 16, a second valve body 18, a second valve cartridge 20, a second cartridge nut 22, a bridge 24, 24', and a tray 26. Valve assemblies are well-known in the art and, therefore, only the relevant components of the valve assembly 10, 10' will be described in greater detail.

An exemplary embodiment of the first valve body 12 and the second valve body 18 is shown in FIGS. 3*a*-3*g*. Each valve body 12, 18 includes a first end section 28, a second end section 30, and an intermediate section 32. The first end section 28 of each valve body 12, 18 includes a first opening 34 and a first outer surface 36. The first opening 34 in each valve body 12, 18 is operable to fluidly connect to a water supply, e.g., a hot water supply or a cold water supply. The first outer surface 36 of each valve body 12, 18 includes first structure operable to secure each valve body 12, 18 from below a mounting surface. In an exemplary embodiment, the first securing structure is first threads 38. The second end section 30 of each valve body 12, 18 includes a second opening 40 and a second outer surface 42. The second opening 40 in each valve body 12, 18 is operable to receive a valve cartridge. The second outer surface 42 of each valve body 12, 18 includes second structure operable to secure each valve body 12, 18 from above the mounting surface. In an exemplary embodiment, the second securing structure is second threads 44. Additionally, the second outer surface 42 of each valve body 12, 18 includes first structure operable to retain each valve cartridge 14, 20 in each valve body 12, 18. In an exemplary embodiment, the first retaining structure is third threads 46. Each valve body 12, 18 includes a passageway 48 extending between the first opening 34 and the second opening 40. The intermediate section 32 of each valve body 12, 18 extends between the first end section 28 of each valve body 12, 18 and the second end section 30 of each valve body 12, 18. The intermediate section 32 of each valve body 12, 18 includes a third opening 50 and a third outer surface 52. The third opening 50 in each valve body 12, 18 is in fluid communication with the passageway 48. Each valve body 12, 18 includes a key 54 extending outwardly from the third outer surface 52 of each valve body 12, 18. In an exemplary embodiment, the first valve body 12 and the second valve body 18 are made from a metal. In an exemplary embodiment, the first valve body 12 and the second valve body 18 are made from brass.

An exemplary embodiment of the first valve cartridge 14 and the second valve cartridge 20 is shown in FIGS. 4*a*-4*f*. In an exemplary embodiment, each valve cartridge 14, 20 includes a cartridge shell 56, a stem bearing 58, an upper disc 60, a lower disc 62, a seal 64, a retaining ring 66, and O-rings 68. The first valve cartridge 14 is operable to control the volume of water flowing from a first water supply, e.g., a hot water supply. The second valve cartridge 20 is operable to control the volume of water flowing from a second water supply, e.g., a cold water supply. Valve cartridges are well-known in the art and, therefore, will not be described in greater detail.

An exemplary embodiment of the first cartridge nut 16 and the second cartridge nut 22 is shown in FIGS. 5*a*-5*d*. Each cartridge nut 16, 22 includes second structure operable to retain each valve cartridge 14, 20 in each valve body 12, 18. In an exemplary embodiment, the second retaining structure is fourth threads 70. The first cartridge nut 16 is operable to retain the first valve cartridge 14 in the first valve body 12. The second cartridge nut 22 is operable to retain the second valve cartridge 20 in the second valve body 18. Cartridge nuts are well-known in the art and, therefore, will not be described in greater detail.

An exemplary embodiment of the bridge 24 is shown in FIGS. 6*a*-6*h*. An exemplary embodiment of the bridge 24' is shown in FIGS. 7*a*-7*g*. The bridge 24, 24' includes a first end 72 and a second end 74. The first end 72 of the bridge 24, 24' includes a first opening 76. The first opening 76 in the bridge 24, 24' is operable to fluidly connect to the third opening 50 in the first valve body 12. The second end 74 of the bridge 24, 24' includes a second opening 78. The second opening 78 in the bridge 24, 24' is operable to fluidly connect to the third opening 50 in the second valve body 18. The bridge 24, 24' includes a passageway 80 extending between the first opening 76 and the second opening 78. The bridge 24, 24' includes an outlet 82 between the first end 72 of the bridge 24, 24' and the second end 74 of the bridge 24, 24'. The outlet 82 of the bridge 24, 24' is in fluid communication with the passageway 80. Additionally, the outlet 82 of the bridge 24, 24' is operable to fluidly connect and supply water to a spout of a faucet. In an exemplary embodiment, the bridge 24, 24' is made from a plastic. In an exemplary embodiment, the bridge 24, 24' is made from a modified polyphenylsulfone ("PPS"). In an exemplary embodiment, the bridge 24, 24' is made from a metal. In an exemplary embodiment, the bridge 24, 24' is made from brass.

An exemplary embodiment of the tray 26 is shown in FIGS. 8*a*-8*k*. In an exemplary embodiment, the tray 26 is generally oblong shaped. The tray 26 includes a first end section 84, a second end section 86, and an intermediate section 88. The first end section 84 of the tray 26 includes a first opening 90. In an exemplary embodiment, the tray 26 includes a first keyway 92 extending outwardly from the first opening 90 in the tray 26. Additionally, the first end section 84 of the tray 26 includes two (2) first tabs 94 extending into the first opening 90 in the tray 26. In an exemplary embodiment, the first tabs 94 extending into the first opening 90 in the tray 26 are angled downwardly. The first opening 90 in the tray 26 is operable to receive the first valve body 12 with the first keyway 92 in the tray 26 being operable to receive the key 54 on the first valve body 12 and the first tabs 94 on the tray 26 being operable to interface with the first valve body 12. The second end section 86 of the tray 26 includes a second opening 96. In an exemplary embodiment, the tray 26 includes a second keyway 98 extending outwardly from the second opening 96 in the tray 26. Additionally, the second end section 86 of the tray 26 includes two (2) second tabs 100 extending into the second opening 96 in the tray 26. In an exemplary embodiment, the second tabs 100 extending into the second opening 96 in the tray 26 are angled downwardly. The second opening 96 in the tray 26 is operable to receive the second valve body 18 with the second keyway 98 in the tray 26 being operable to receive the key 54 on the second valve body 18 and the second tabs 100 on the tray 26 being operable to interface with the second valve body 18. While the tray 26 has been shown and described in the illustrated embodiment as including two (2) first tabs 94 and two (2) second tabs 100, one of ordinary skill in the art will appreciate that the tray 26 could include more or less than two (2) first tabs 94 and more or less than two (2) second tabs 100 and that there could be a different number of first tabs 94 and second tabs 100. In an exemplary embodiment, an inner diameter of the first tabs 94 and an inner diameter of the second tabs 100 are less than an outer diameter of the intermediate section 32 of each valve body 12, 14. The intermediate section 88 of the tray 26 extends between the first opening 90 in the first end section 84 of the tray 26 and the second opening 96 in the second end section 86 of the tray 26. In an exemplary embodiment, the tray 26 is made from a metal. In an exemplary embodiment, the tray 26 is made from stainless steel.

The tray 26 includes a ridge 102 extending around at least a portion of the tray 26. In the illustrated embodiment, the ridge 102 extends around the entire tray 26 near a perimeter 104 of the tray 26 with two (2) discontinuities 106 in the ridge 102 on the intermediate section 88 of the tray 26. In the illustrated embodiment, one (1) discontinuity 106 is for a lift rod used with the fixed spout and one (1) discontinuity 106 is for a lift rod used with the swing spout.

While the tray 26 has been shown and described in the illustrated embodiment as including a ridge 102 that extends around the entire tray 26 near a perimeter 104 of the tray 26 with two (2) discontinuities 106 in the intermediate section 88 of the tray 26, one of ordinary skill in the art will appreciate that the ridge 102 does not need to extend around the entire tray 26, there could be more or less than two (2) discontinuities 106, and a distance of the ridge 102 from the perimeter 104 of the tray 26 could vary. For example, the ridge 102 could only extend around the intermediate section 88 of the tray 26 and not extend around the first opening 90 in the tray 26 and the second opening 96 in the tray 26.

In an exemplary embodiment, the ridge 102 on the tray 26 extends partially around the tray 26. In an exemplary embodiment, the ridge 102 extends around at least twenty percent (20%) of the tray 26. In an exemplary embodiment, the ridge 102 extends around at least forty percent (40%) of the tray 26. In an exemplary embodiment, the ridge 102 extends around at least sixty percent (60%) of the tray 26.

In an exemplary embodiment, the ridge 102 on the tray 26 extends partially around the intermediate section 88 of the tray 26, i.e., between the first opening 90 in the tray 26 and the second opening 96 in the tray 26. In an exemplary embodiment, the ridge 102 extends around at least forty percent (40%) of the intermediate section 88 of the tray 26. In an exemplary embodiment, the ridge 102 extends around at least sixty percent (60%) of the intermediate section 88 of the tray 26. In an exemplary embodiment, the ridge 102 extends around at least eighty-five percent (85%) of the intermediate section 88 of the tray 26.

During assembly of the valve assembly 10, 10', the first valve cartridge 14 and the second valve cartridge 20 are inserted into the first valve body 12 and the second valve body 18, respectively. The first cartridge nut 16 and the second cartridge nut 22 are threaded onto the first valve body 12 and the second valve body 18, respectively. O-rings 108 are placed on the first end 72 and the second end 74 of the bridge 24, 24'. The first end 72 and the second end 74 of the bridge 24, 24' are inserted into the third opening 50 in the first valve body 12 and the third opening 50 in the second valve body 18, respectively. The key 54 of the first valve body 12 and the key 54 of the second valve body 18 are aligned with the first keyway 92 and the second keyway 98 in the tray 26, respectively. The first end section 28 of the first valve body 12 and the first end section 28 of the second valve body 18 are inserted into the first opening 90 and the second opening 96 in the tray 26, respectively, until the intermediate section 32 of the first valve body 12 and the intermediate section 32 of the second valve body 18 interface with the first opening 90 and the second opening 96 in the tray 26, respectively. Once assembled, the key 54 of the first valve body 12 and the key 54 of the second valve body 18 interface with the first keyway 92 and the second keyway 98 in the tray 26, respectively.

As the first valve body 12 and the second valve body 18 are inserted into the first opening 90 and the second opening 96 in the tray 26, respectively, an interference press fit is created between the first valve body 12 and the second valve body 18 and the tray 26. More specifically, as the first valve body 12 and the second valve body 18 are inserted into the first opening 90 and the second opening 96 in the tray 26, respectively, the third outer surface 52 of the first valve body 12 and the third outer surface 52 of the second valve body 18 deform the first tabs 94 extending into the first opening 90 and the second tabs 100 extending into the second opening 96, respectively. The deformation of the first tabs 94 and the second tabs 100 includes both elastic (or reversible) deformation and plastic (or irreversible) deformation. As a result of the elastic deformation, a preload is created between the first valve body 12 and the second valve body 18 and the tray 26.

The valve assembly 10, 10' can be installed as part of a faucet. As shown in FIGS. 9*a*-9*f*, the valve assembly 10 is installed as part of a faucet 110. In an exemplary embodiment, the faucet 110 includes a spout 112, a first handle 114, a second handle 116, and an escutcheon 118. The faucet 110 can be installed on a mounting surface M. The mounting surface M includes a first mounting hole H1 and a second mounting hole H2. The first end section 28 of the first valve body 12 and the first end section 28 of the second valve body 18 are inserted into the first mounting hole H1 and the second mounting hole H2 in the mounting surface M, respectively, until the intermediate section 32 of the first valve body 12 and the intermediate section 32 of the second valve body 18 interface with the first mounting hole H1 and the second mounting hole H2 in the mounting surface M, respectively. The faucet 110 is installed over the valve assembly 10. More specifically, the escutcheon 118 is installed over the entire valve assembly 10, the spout 112 is installed over the outlet 82 of the bridge 24, the first handle 114 is installed over the first valve cartridge 14, and the second handle 116 is installed over the second valve cartridge 20. In the installed state, the tray 26 does not contact the mounting surface M.

One of ordinary skill in the art will now appreciate that the present invention provides a valve assembly for a faucet that provides a rigid mounting for valve bodies. Although the present invention has been shown and described with reference to particular embodiments, equivalent alterations and modifications will occur to those skill in the art upon reading and understanding this specification. The present invention includes all such equivalent alterations and modifications and is limited only by the scope of the following claims in light of their full scope of equivalents.

What is claimed is:

1. A valve assembly for a faucet, comprising:

a first valve body, the first valve body including a first end section and a second end section, the first end section of the first valve body including a first opening, the first opening in the first valve body being operable to fluidly connect to a first water supply, the second end section of the first valve body including a second opening, the second opening in the first valve body being operable to receive a first valve cartridge, the first valve body including a first passageway extending between the first opening and the second opening in the first valve body, the first valve body including a third opening between the first end section and the second end section of the first valve body, the third opening in the first valve body being in fluid communication with the first passageway in the first valve body, the first valve body including a first key extending outwardly therefrom between the first end section and the second end section of the first valve body;

a second valve body, the second valve body including a first end section and a second end section, the first end section of the second valve body including a first opening, the first opening in the second valve body being operable to fluidly connect to a second water supply, the second end section of the second valve body including a second opening, the second opening in the second valve body being operable to receive a second valve cartridge, the second valve body including a second passageway extending between the first opening and the second opening in the second valve body, the second valve body including a third opening between the first end section and the second end section of the second valve body, the third opening in the second valve body being in fluid communication with the second passageway in the second valve body, the second valve body including a second key extending outwardly therefrom between the first end section and the second end section of the second valve body; and a tray, the tray including a first end section, a second end section, and an intermediate section, the first end section of the tray including a first opening, the tray including a first keyway extending outwardly from the first opening in the tray, the first opening in the tray being operable to receive the first valve body with the first keyway in the tray being operable to receive the first key on the first valve body, the second end section of the tray including a second opening, the tray including a second keyway extending outwardly from the second opening in the tray, the second opening in the tray being operable to receive the second valve body with the second keyway in the tray being operable to receive the second key on the second valve body, the intermediate section of the tray extending between the first opening and the second opening in the tray, the tray including a ridge, the ridge extending around at least a portion of the first end section of the tray, at least a portion of the second end section of the tray, and at least a portion of the intermediate section of the tray, the ridge including a top portion, the first end section of the tray including a first tab extending from the top portion of the ridge into the first opening in the tray, the second end section of the tray including a second tab extending from the top portion of the ridge into the second opening in the tray.

2. The valve assembly of claim 1, wherein:

the first end section of the tray includes two first tabs extending into the first opening in the tray; and the two first tabs of the tray extend from opposite sides of the first end section of the tray.

3. The valve assembly of claim 1, wherein:

the second end section of the tray includes two second tabs extending into the second opening in the tray; and the two second tabs of the tray extend from opposite sides of the second end section of the tray.

4. The valve assembly of claim 1, wherein the first tab of the tray extends downwardly from the top portion of the ridge.

5. The valve assembly of claim 1, wherein the second tab of the tray extends downwardly from the top portion of the ridge.

6. The valve assembly of claim 1, wherein the first tab of the tray is arc-shaped.

7. The valve assembly of claim 1, wherein the second tab of the tray is arc-shaped.

8. A valve assembly for a faucet, comprising:

a first valve body, the first valve body including a first end section, a second end section, and an intermediate section, the first end section of the first valve body including a first opening, the first opening in the first valve body being operable to fluidly connect to a first water supply, the second end section of the first valve body including a second opening, the second opening in the first valve body being operable to receive a first valve cartridge, the first valve body including a first passageway extending between the first opening and the second opening in the first valve body, the intermediate section of the first valve body including a third opening between the first end section and the second end section of the first valve body, the third opening in the first valve body being in fluid communication with the first passageway in the first valve body, the first valve body including a first inner key and a first outer key extending outwardly from the intermediate section of the first valve body, the first inner key being formed by a portion of the intermediate section of the first valve body that forms the third opening in the first valve body;

a second valve body, the second valve body including a first end section, a second end section, and an intermediate section, the first end section of the second valve body including a first opening, the first opening in the second valve body being operable to fluidly connect to a second water supply, the second end section of the second valve body including a second opening, the second opening in the second valve body being operable to receive a second valve cartridge, the second valve body including a second passageway extending between the first opening and the second opening of the second valve body, the intermediate section of the second valve body including a third opening between the first end section and the second end section of the second valve body, the third opening in the second valve body being in fluid communication with the second passageway in the second valve body, the second valve body including a second inner key and a second outer key extending outwardly from the intermediate section of the second valve body, the second inner key being formed by a portion of the intermediate section of the second valve body that forms the third opening in the second valve body; and a tray, the tray including a first end section, a second end section, and an intermediate section, the first end section in the tray including a first opening, the tray including a first inner keyway and a first outer keyway extending outwardly from the first opening in the tray, the first opening in the tray being operable to receive the first valve body with the first inner keyway in the tray being operable to receive the first inner key on the first valve body and the first outer keyway in the tray being operable to receive the first outer key on the first valve body, the second end section of the tray including a second opening, the tray including a second inner keyway and a second outer keyway extending outwardly from the second opening in the tray, the second opening in the tray being operable to receive the second valve body with the second inner keyway in the tray being operable to receive the second inner key on the second valve body and the second outer keyway in the tray being operable to receive the second outer key on the second valve body, the intermediate section of the tray extending between the first opening and the second opening in the tray, the tray including a ridge, the ridge extending around at least a portion of the intermediate section of the tray.

9. The valve assembly of claim 8, wherein the first inner key and the first outer key of the first valve body extend from opposite sides of the intermediate section of the first valve body.

10. The valve assembly of claim 8, wherein the second inner key and the second outer key of the second valve body extend from opposite sides of the intermediate section of the second valve body.

11. The valve assembly of claim 8, wherein the first inner keyway in the tray is larger than the first outer keyway in the tray.

12. The valve assembly of claim 8, wherein the second inner keyway in the tray is larger than the second outer keyway in the tray.

13. The valve assembly of claim 8, wherein the intermediate section of the first valve body has a generally circular cross-sectional shape.

14. The valve assembly of claim 8, wherein the intermediate section of the second valve body has a generally circular cross-sectional shape.

15. The valve assembly of claim 8, wherein the first opening in the tray is generally circular shaped.

16. The valve assembly of claim 8, wherein the second opening in the tray is generally circular shaped.

17. A valve assembly for a faucet, comprising:

a first valve body, the first valve body including a first end section and a second end section, the first end section of the first valve body including a first opening, the first opening in the first valve body being operable to fluidly connect to a first water supply, the second end section of the first valve body including a second opening, the second opening in the first valve body being operable to receive a first valve cartridge, the first valve body including a first passageway extending between the first opening and the second opening in the first valve body, the first valve body including a third opening between the first end section and the second end section of the first valve body, the third opening in the first valve body being in fluid communication with the first passageway, the first valve body including a first key extending outwardly therefrom between the first end section and the second end section of the first valve body;

a second valve body, the second valve body including a first end section and a second end section, the first end section of the second valve body including a first opening, the first opening in the second valve body being operable to fluidly connect to a second water supply, the second end section of the second valve body including a second opening, the second opening in the second valve body being operable to receive a second valve cartridge, the second valve body including a passageway extending between the first opening and the second opening of the second valve body, the second valve body including a third opening between the first end section and the second end section of the second valve body, the third opening in the second valve body being in fluid communication with the second passageway, the second valve body including a second key extending outwardly therefrom between the first end section and the second end section of the second valve body; and a tray, the tray including a first end section, a second end section, and an intermediate section, the first end section of the tray including a first opening, the tray including a first keyway extending outwardly from the first opening in the tray, the first opening in the tray being operable to receive the first valve body with the first keyway in the tray being operable to receive the first key on the first valve body, the second end section of the tray including a second opening, the tray including a second keyway extending outwardly from the second opening, the second opening in the tray being operable to receive the second valve body with the second keyway in the tray being operable to receive the second key on the second valve body, the intermediate section of the tray extending between the first opening and the second opening in the tray, the tray including a ridge, the ridge extending around at least a portion of the first end section of the tray, at least a portion of the second end section of the tray, and at least a portion of the intermediate section of the tray, the ridge having a substantially uniform width in the intermediate section of the tray.

18. The valve assembly of claim 17, wherein the ridge has a substantially uniform width in the first end section of the tray and the second end section of the tray.

19. The valve assembly of claim 17, wherein the ridge has a substantially uniform height in the intermediate section of the tray.

20. The valve assembly of claim 17, wherein the ridge has a substantially uniform height in the first end section of the tray and the second end section of the tray.

* * * * *